US006692547B2

(12) United States Patent
Kim

(10) Patent No.: US 6,692,547 B2
(45) Date of Patent: Feb. 17, 2004

(54) METHOD FOR PREPARING ABRASIVE ARTICLES

(75) Inventor: Yong-Bum Kim, Siheung-si (KR)

(73) Assignee: Sun Abrasives Corporation, Ansan (KR)

( * ) Notice: Subject to any disclaimer, the term of this patent is extended or adjusted under 35 U.S.C. 154(b) by 60 days.

(21) Appl. No.: 10/117,589

(22) Filed: Apr. 5, 2002

(65) Prior Publication Data

US 2003/0046874 A1 Mar. 13, 2003

(30) Foreign Application Priority Data

Aug. 28, 2001 (KR) ..... 2001-0052156

(51) Int. Cl.[7] ..... B24D 11/00; B24D 3/34

(52) U.S. Cl. ..... 51/298; 51/297; 51/307; 51/308; 51/309

(58) Field of Search ..... 51/293, 298, 297, 51/307, 308, 309

(56) References Cited

U.S. PATENT DOCUMENTS 5,913,716 A * 6/1999 Mucci et al. ..... 451/59

FOREIGN PATENT DOCUMENTS

GB 1 451 331 * 9/1976

* cited by examiner

*Primary Examiner*—Michael Marcheschi

(57) ABSTRACT

A method for preparing an abrasive article of the present invention comprises coating a conductive binder resin on one surface of a cylinder paper or greige cloth, coating abrasive particles on one side of a PET or nylon film, and combining the coated surface of the cylinder paper or greige cloth with the other side of the PET or nylon film.

9 Claims, 1 Drawing Sheet

METHOD FOR PREPARING ABRASIVE ARTICLES

FIELD OF THE INVENTION

The present invention relates to an improved method for preparing an abrasive article of good quality in an efficient manner.

BACKGROUND OF THE INVENTION

Abrasive articles used for grinding or polishing various wood products, e.g., plywoods or MDF(medium density fiber) boards, are generally produced by coating abrasives on a backing formed by combining a woven fabric of cotton or polyester/cotton with a kraft paper.

GB Patent No. 1,451,331 discloses an abrasive sheet prepared by laminating a cylinder paper and a polyester film to form a backing, coating abrasive grains thereon with an adhesive, e.g., phenolic formaldehyde resin, and curing the coated laminate at a high temperature. During the curing step, however, the moisture content of the cylinder paper decreases rapidly, causing the abrasive sheet to deform and warp. Accordingly, a moisturizing step is required to restore the original moisture content of the cylinder paper.

SUMMARY OF THE INVENTION

Accordingly, it is a primary object of the present invention to provide a simple, efficient method for preparing abrasive articles having good performance properties.

In accordance with the present invention, there is provided a method for preparing an abrasive article comprising coating a conductive binder resin on one surface of a cylinder paper or greige cloth, coating abrasive particles on one side of a PET or nylon film, and combining the coated surface of the cylinder paper or greige cloth with the other side of the PET or nylon film.

BRIEF DESCRIPTION OF THE DRAWINGS

The above and other objects and features of the present invention will become apparent from the following description thereof, when taken in conjunction with the accompanying drawings wherein.

DETAILED DESCRIPTION OF THE INVENTION

The present invention provides a highly productive method for preparing abrasive articles having an improved moisture content maintenance property, which comprises coating a conductive binder resin on one surface of a cylinder paper or greige cloth, coating abrasive particles on one side of a PET or nylon film, and combining the coated surface of the cylinder paper or greige cloth with the other side of the PET or nylon film.

In the present invention, a cylinder paper or greige cloth having a weight per area value of 150 to 400 g/cm$^2$ is preferably used together with a PET or nylon film having a thickness of 75 to 180 $\mu$m, preferably 150 $\mu$m.

The conductive binder resin employed in combining the coated side of the cylinder paper or greige cloth with the opposite side of the film to the side having a layer of coated abrasive particles thereon may be any of the binder resins generally used in the art. The conductive binder resin is used in an amount ranging from 60 to 70 g/m$^2$. When the amount of the binder resin applied is less than 60 g/m$^2$, adhesion between the layers may be insufficient, and when the amount of binder resin used is more than 70 g/m$^2$, a longer drying time may be required.

A conductive binder resin may be prepared by dissolving a conductive self-crosslinkable resin and a hardener in a solvent, e.g., an alcohol. The conductive self-crosslinkable resin becomes crosslinked by the action of the hardner during drying, e.g., 40 to 60 seconds at an ambient temperature, forming a sticky coating layer which acts as an effective glue even at a room temperature. Preferable conductive self-crosslinkable resins that may be employed in the present invention, are epoxy resins, urethane resins, polyester resins, rubber compositions and a mixture thereof. The alcohol solvent may be methanol, ethanol, isobutanol or others.

Figure 1:
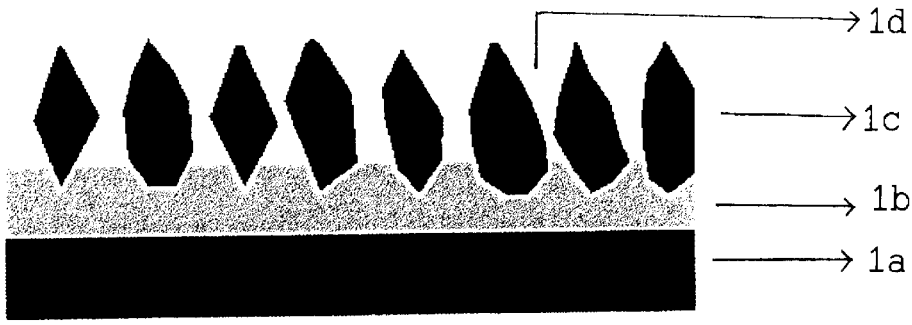
FIG. 1 illustrates a cross-sectional view of an abrasive article.

A cross-sectional view of the film with abrasive particles is shown in FIG. 1. The film having a layer of coated abrasive particles is generally prepared by applying abrasive particles to one side of a PET or a nylon film (1*a*). For example, a resin containing isocyanate groups (1*b*), e.g., a urethane, epoxy or urethane-epoxy resin having NCO groups is applied on one side of the film and then abrasives particles (1*c*) are bonded thereon. After pre-drying, the resulting abrasive coated surface is treated with a thermosetting adhesive resin (1*d*), e.g., phenol, urea, melamine, epoxy and furan resins, dried and hardened to form a layer of abrasive particles firmly bonded to the film. Any abrasive particles which are used in the art may be used in the present invention, and examples are particles of alumina, silicone carbide (SiC), ceramic alumina, alumina zirconia and a mixture thereof.

In the inventive method, the abrasive film thus obtained is combined with the adhesives-coated cylinder paper or greige cloth at a low temperature to avoid deleterious effects brought about by moisture loss. Accordingly, the inventive method is much simple and much more productive than conventional processes, giving an abrasive article having good performance characteristics, e.g., an improved moisture content maintenance property.

The inventive abrasive article may be provided in the form of abrasive belt, abrasive sheet, abrasive disc or others.

The following Examples are given for the purpose of illustration only, and are not intended to limit the scope of the invention.

EXAMPLE 1

Preparation 1: Abrasive Film

A urethane resin adhesive (two-liquid type having isocyanate groups and a high average molecular weight ($M_w$) above 10,000) was coated on one surface of a polyester film (thickness: 125 $\mu$m) in an amount of 60 g/m$^2$, and dried while varying the temperature from 90 to 105 to 120° C. for a total period of about 60 min. Then, an epoxy resin was applied thereon in an amount of 200 g/m$^2$, silicon carbide particles were projected on the adhesive-coated surface, and dried at 90 to 105° C. for about 60 min, to obtain a polyester film having bonded silicon carbide particles. The resulting polyester film was treated with a phenolic resin (RESOLE type having molar ratio of 1:1.6), dried at 95~115° C. for 70 min, and cured at 110° C. for 200 min, to obtain a film having a layer of coated abrasive particles.

Preparation 2: Abrasive Article

Figure 2:
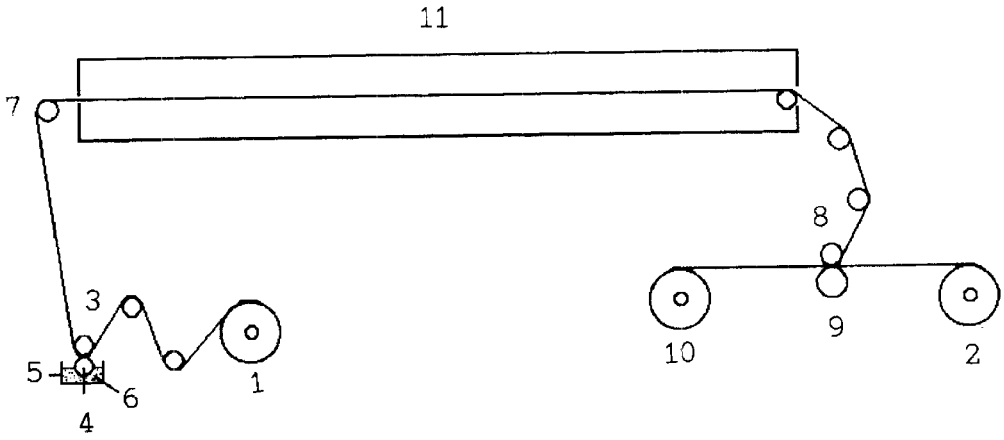
FIG. 2 depicts a schematic diagram for preparing an abrasive article in accordance with the present invention.

Referring to FIG. 2, a cylinder paper (150~400 g/m$^2$) supplied through roll (1) was introduced into tank (5) containing a conductive self-crosslinkable urethane resin adhesive (6) [100 parts of a 80% urethane resin solution ($M_w$=8000~10000) and 35 parts of an epoxy-containing hardener (200 to 300 equivalent); viscosity at 25±2° C.: 2500~3500 cps], coated with the urethane resin adhesive (6) using calendar roll (3) and gravure roll (4), and then, the cylinder paper was led by driving roll (7) into dryer (11), followed by drying at below 50° C. The dried cylinder paper and the silicon carbide-coated polyester film of Preparation 1 supplied through roll (2) were brought together and pressed using pressure rolls (8, 9) to attach each other. The abrasive article thus prepared was wound into roll (10).

EXAMPLE 2

The procedure of Example 1 was repeated except that an epoxy resin [100 parts of a 75% epoxy resin solution (400 to 450 equivalent) and 25 parts of a 70% amine hardener (amine value: 300 to 350); viscosity at 25±2° C.: 3000~3500 cps] was used instead of the urethane resin as a self-crosslinkable adhesive to prepare an abrasive article.

Comparative Example 1

Comparative Preparation 1: Film/Paper Backing

As shown in FIG. 2, a cylinder paper (150~400 g/m$^2$) supplied through roll (1) was introduced into tank (5) containing a self-crosslinkable urethane resin adhesive (6) [100 parts of a 80% urethane resin solution ($M_w$= 8000~10000) and 35 parts of an epoxy-containing hardener (200 to 300 equivalent); viscosity at 25±2° C.: 2500~3500 cps], coated with the urethane resin adhesive (6) using calendar roll (3) and gravure roll (4), and then, the cylinder paper was led by driving roll (7) into dryer (11), followed by drying at below 50° C. The dried cylinder paper and a polyester film(thickness: 150 $\mu$m) supplied through roll (2) were brought together and pressed using pressure rolls (8, 9) to attach each other. The film/cylinder paper backing thus prepared was wound into roll (10).

In the above step of combining the cylinder paper with the polyester film, the problems of curling and shrinking of the combined film were obtained.

Comparative Preparation 2: Abrasive Article

A urethane resin adhesive (two-liquid type having isocyanate groups and a high molecular weight of above 10,000) was applied to one side of the film obtained in Comparative Preparation 1 in an amount of 60 g/m$^2$, dried at 90~120° C. for 60 min, an epoxy resin adhesive was applied thereon in an amount of 200 g/m$^2$, silicon carbide particles were coated thereon, and dried at 80~105° C. for 1 hr, to prepare a silicon carbide/backing. The silicon carbide/backing was treated with a phenolic resin, dried at 85~115° C. for 70 min, and cured at 110° C. for 200 min, to obtain an abrasive article.

The abrasive article obtained in Comparative Example 1 showed some warping, due to the excessive lowering of the moisture content of the cylinder paper during the final drying step conducted at above 100° C. Accordingly, supplementary water was sprayed on the surface of the cylinder paper at a rate of 300~400 g/m$^2$ and allowed to equilibrate at room temperature for 48 hrs. However, the warping still persisted. The cylinder paper was treated once more with water (300~400 g/m$^2$) and left at room temperature for 48 hrs, to finally obtain a flat abrasive article.

Experiment 1

The abrasive articles prepared in Examples 1 and 2, and Comparative Example 1 were tested for physical properties, e.g., tensile strength, stretch rate, adhesive strength and the like, according to KS K 0536, KS K 0520 and KS K 0533. The result is shown in Table 1:

TABLE 1

| Physical Test | Example 1 | Example 2 | Comparative Example 1 |
|---|---|---|---|
| Tensile strength (kgf/inch), M.D. | 120 | 120 | 120 |
| Tearing strength (gf/43 mm), M.D. | 4,000 | 4,000 | 4,000 |
| Stretch rate, M.D./45 kgf (%) | 2.0 | 2.0 | 2.0 |
| $R_{max}$ | 9.8 | 9.9 | 9.8 |
| Weight per area value (g/m$^2$) | 1,000 | 1,080 | 1,000 |
| Adhesion (kgf/2 inch) | ∞ | ∞ | ∞ |
| Time required for post-humidifying (hrs) | 0 | 0 | 96 |
| Response to varying relative humidity | No change | No change | Curled in more than 60% of relative humidity |

As can be seen in Table 1, the abrasives of Examples 1 and 2 have satisfactory performance properties similar to those of the abrasive of Comparative Example 1. However, the abrasive film of Comparative Example 1 must be prepared using a complicated process that includes a lengthy humidifying step and it still gives a problem of curling at a relative humidity of 60% or higher.

Therefore, the inventive method for preparing abrasive articles is far superior to conventional methods in terms of productivity and product quality.

While the invention has been described with respect to the specific embodiments, it should be recognized that various modifications and changes may be made by those skilled in the art to the invention which also fall within the scope of the invention as defined as the appended claims.

What is claimed is:

1. A method for preparing an abrasive article comprising coating a conductive binder resin on one surface of a cylinder paper or greige cloth, coating abrasive particles on one side of a PET or nylon film, and combining the coated surface of the cylinder paper or greige cloth with the other side of the PET or nylon film.

2. The method of claim 1, wherein the conductive binder resin contains a hardner and a conductive self-crosslinkable resin selected from the group consisting of an epoxy resin, a urethane resin, a polyester resin, a rubber composition and a mixture thereof.

3. The method of claim 1, wherein the conductive binder resin is applied to the cylinder paper or greige cloth in an amount of 60 to 70 g/m$^2$.

4. The method of claim 1, wherein the step of combining the cylinder paper of greige cloth with the film is carried out at 60 to 80° C.

5. The method of claim 1, wherein the abrasive particles are particles of a compound selected from the group consisting of alumina, silicon carbide, ceramic alumina, alumina zirconia and a mixture thereof.

6. The method of claim 1, wherein the cylinder paper or greige cloth has a weight/area value of 150 to 400 g/m$^2$.

7. The method of claim 1, wherein the PET or nylon film has a thickness of 75 to 180 $\mu$m.

8. The method of claim 2, wherein the conductive binder resin is applied to the cylinder paper or greige cloth in an amount of 60 to 70 g/m$^2$.

9. The method of claim 2, wherein the step of combining the cylinder paper of greige cloth with the film is carried out at 60 to 80° C.

* * * * *